United States Patent [19]

McCabe

[11] 4,114,646

[45] Sep. 19, 1978

[54] ROTATING BLADE FIRE DAMPER

[76] Inventor: Francis J. McCabe, 239 Hastings Ct., Doylestown, Pa. 18901

[21] Appl. No.: 764,774

[22] Filed: Feb. 2, 1977

Related U.S. Application Data

[63] Continuation of Ser. No. 689,994, May 26, 1976, Pat. No. 4,081,173.

[51] Int. Cl.[2] ..... F24F 13/14; F16K 1/22

[52] U.S. Cl. ..... 137/601; 49/92; 98/110

[58] Field of Search ..... 49/91, 92; 98/110, 112, 98/113, 121 A; 251/305, 308; 137/601

[56] References Cited

U.S. PATENT DOCUMENTS

| | | | |
|---|---|---|---|
| 2,654,921 | 10/1953 | Blanchard | 49/91 X |
| 2,759,573 | 8/1956 | Schwab | 49/92 X |
| 2,996,768 | 8/1961 | Brown | 49/92 |
| 3,381,601 | 5/1968 | McCabe | 98/121 A |
| 3,741,102 | 6/1973 | Kaiser | 98/110 |

*Primary Examiner*—Robert G. Nilson
*Attorney, Agent, or Firm*—Benasutti Associates, Ltd.

[57] ABSTRACT

A novel fire, smoke and air control damper is disclosed wherein one or more hook-shaped hinge portions formed intermediate between the longitudinal edges of each damper blade engage complementally configured hook-shaped hinge elements formed on opposite sides of the damper frame. Formed on each of the ends of each damper blade are additional hook-shaped sealing portions which are adapted to mate with the hook-shaped sealing portions of adjacent blades in the closed position in order to form a double seal. A "dead" air chamber is formed between contiguous portions of adjacent blades when those blades are in the closed position. As the blades are slightly displaced towards the open position, a seal is nonetheless maintained between the blades due to the configuration of the sealing portions thereof. As the blades are further displaced, a serpentine air path is formed having a maximum fluid frictional resistance, which resistance is further amplified by the provision of a spoiler disposed adjacent to the tip of each hook-shaped sealing portion of each blade. Finally, the blades are movable to any of a variety of open positions so that volume control is easily effectuated.

In the closed position, various blade portions also engage opposite sides of an inwardly depending flange in said frame to form a seal therebetween, thereby providing a positive pressure resistant seal.

3 Claims, 7 Drawing Figures

ROTATING BLADE FIRE DAMPER

This is a continuation of application Ser. No. 689,994, filed May 26, 1976 now U.S. Pat. No. 4,081,173.

BACKGROUND OF THE INVENTION

The present invention relates generally to the field of air control dampers, and more particularly, to those air control dampers which are intended to regulate the volume of air passed along a duct or plenum, or through an opening, and which damper is further adapted to prevent the passage of smoke or fire therethrough when the damper is in a closed position. For discussions of some of the problems encountered in the fire, smoke and air control damper field, please refer to my previously issued U.S. Pat. Nos. 3,381,601; 3,204,548; 3,605,603; and 3,899,156.

In particular, a suitable fire, smoke and air control damper should be easily operable to allow the flow of air therethrough at any of a desired number of predetermined settings between the closed and open positions of the blades with respect to the frame. With respect to the fire and smoke control aspect of such a damper, it is also important that a damper be capable of withstanding intense heat and/or air pressures which impinge on either side of the damper for substantial periods of time during a fire. Due to the extreme conditions to which such a damper is subjected, it is necessary to provide extremely strong blades and a very substantial frame which, together, form a tight, positive seal to effectively shut off the air duct, opening, or plenum. In fact, due to the deficiencies experienced by some practitioners in this field, folding blade fire dampers such as those illustrated in my previously issued U.S. Pat. Nos. 3,866,656; 3,866,657; 3,814,165; 3,401,734; 3,727,663; 3,327,764; and 3,273,632 have been utilized in order to overcome those deficiencies otherwise encountered by some devices utilizing a plurality of rotating blades, each of which blades must form a seal with an adjacent blade as well as the frame, which seal is sometimes prone to leakage in the event that extremely precise alignments and tolerances are not maintained. This problem has been accentuated by the fact that a smoke and fire damper must function effectively years after it is installed in a relatively dirty environment.

Prior art rotating blade fire and smoke dampers have therefore incorporated extremely heavy materials which are not subject to easy bending or deformation in the presence of heat. The blades are mounted by distinct hinge or pivot means which are separately installed for the purpose of aligning each of the blades for rotational movement and to ensure the interengagement of each blade with its adjacent blade to form a seal therebetween which does not open in the presence of heat or excessive pressures, such as those which might be encountered during a fire.

SUMMARY OF THE INVENTION

The present invention overcomes many of the disadvantages of prior art fire, smoke and air control dampers by providing a rotating blade fire damper which in the fully closed position provides for a positive double seal between hook-shaped sealing portions of adjacent blades. Unlike prior art fire dampers, the present invention is readily constructed from relatively light sheet metal materials and incorporates a novel blade configuration wherein a hook-shaped hinge portion is disposed intermediate between these sealing portions. The hook-shaped hinge portion of each blade defines that blade into two sections which are parallel and offset by a distance equal to the thickness of an inwardly depending flange formed on the frame. At least two hook-shaped hinge elements are formed on opposite sides of the frame to articulate the frame with respect to the blades to allow rotational displacement of the blade between open and closed positions. In the closed position, each of the aforementioned sections of the blade forms a seal along opposite surfaces of said flange. Finally, in the event that excessive pressures force the blades to open slightly, and/or a slight misalignment of the blade occurs, means are provided to prevent a free air flow from developing. First, means are provided wherein a "dead" air chamber is formed between contiguous portions of adjacent blades. This chamber is formed by the particular configurational interengagement of the hook-shaped sealing portion of adjacent blades. Second, the hook-shaped sealing portions of adjacent blades are configured so that the double seal is maintained even if the blades are slightly displaced toward the open position. This is accomplished by configuring these sealing portions so that the leading edge of the tip portion of each blade will wipe along the offsetting portion of te adjacent blade, thereby substantially maintaining the seal between the blades. Consequently, as the blades move from the fully closed position slightly towards the open position, the volume of the "dead" air chamber is increased and air leakage, if any, is provided with a serpentine air path which maximizes the fluid frictional resistance of that air path. Additional spoiler means for creating turbulences are provided within the air chamber to further hinder the travel of smoke or air therethrough.

The aforementioned hook-shaped hinge portions and hook-shaped sealing portions of the blades further act as reinforcing ribs which strengthen each blade along its longitudinal axis, thereby either allowing the damper to be constructed from lighter or relatively thinner materials, or to be substantially stronger when materials of conventional thicknesses are employed in its construction.

Accordingly, a primary object of the present invention is the provision of a rotating blade fire and smoke damper with superior sealing characteristics in the closed position. Another object of the present invention is the provision of a rotating blade fire and smoke damper which eliminates the necessity for separate pivot means between the blades and frame. Further objects of the present invention will become apparent from the following, more detailed description.

DETAILED DESCRIPTION OF THE DRAWINGS

Figure 1:
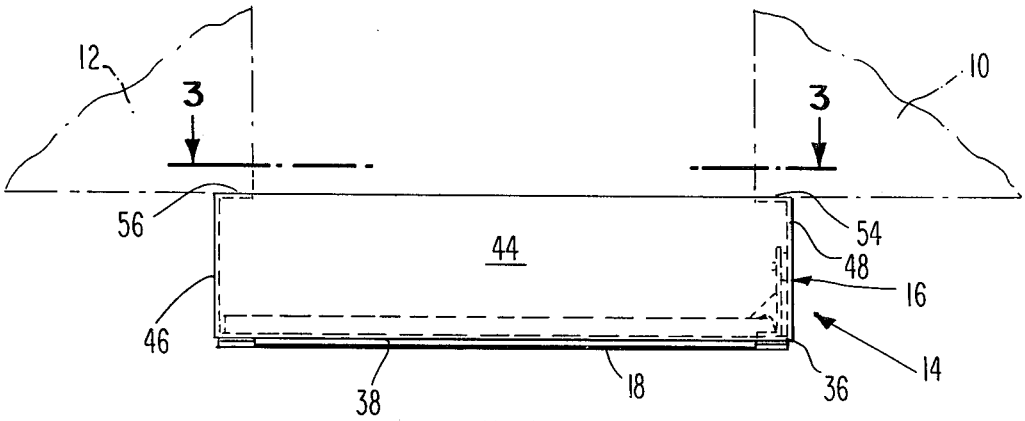
FIG. 1 is a top view of the preferred embodiment of the present invention disposed adjacent to an air flow opening shown in phantom, which opening is broken away.

Referring now to all the figures, and in particular, to FIG. 1, the damper of the present invention in its preferred embodiment is a generally box-shaped damper for disposition in an opening which in FIG. 1 is diagrammatically illustrated by wall sections 10 and 12. The damper, designated generally 14 in the drawings, comprises a frame designated generally 16 and a plurality of blades 18, 22, 26, and 30. The frame designated generally 16 comprises inwardly depending flanges 34 and 36 which are disposed on opposite sides of the frame 16 in a plane which is substantially parallel to the plane of the blades 18, 22, 26, and 30 in the closed position. Additional inwardly depending flanges 38 and 40 are also formed in this plane at the top and bottom of the frame. The first of the aforementioned inwardly depending flanges 34 and 36(the side flanges) ae adapted to form a seal with the ends of blades, while the last of the aforementioned inwardly depending flanges 38 and 40 form seals with top and bottom blades 18 and 30 when those blades are in the closed position. In constructing frame 16 the appropriate portions of the inwardly depending flanges 34, 36, 38, and 40 are notched so that when folded into the aforementioned plane, a seal is formed at intersections 42 by welding, crimping or some other similar suitable method. The frame designated generally 16 further comprises a top 44, a bottom, and sides 46 and 48 which extend generally perpendicularly to inwardly depending flanges 34 and 36 respectively. The construction and assembly of the frame is generally similar to that described in my previously issued U.S. Pat. No. 3,833,989 entitled "Method of Fabricating and Assembling a Damper."

Figure 3:
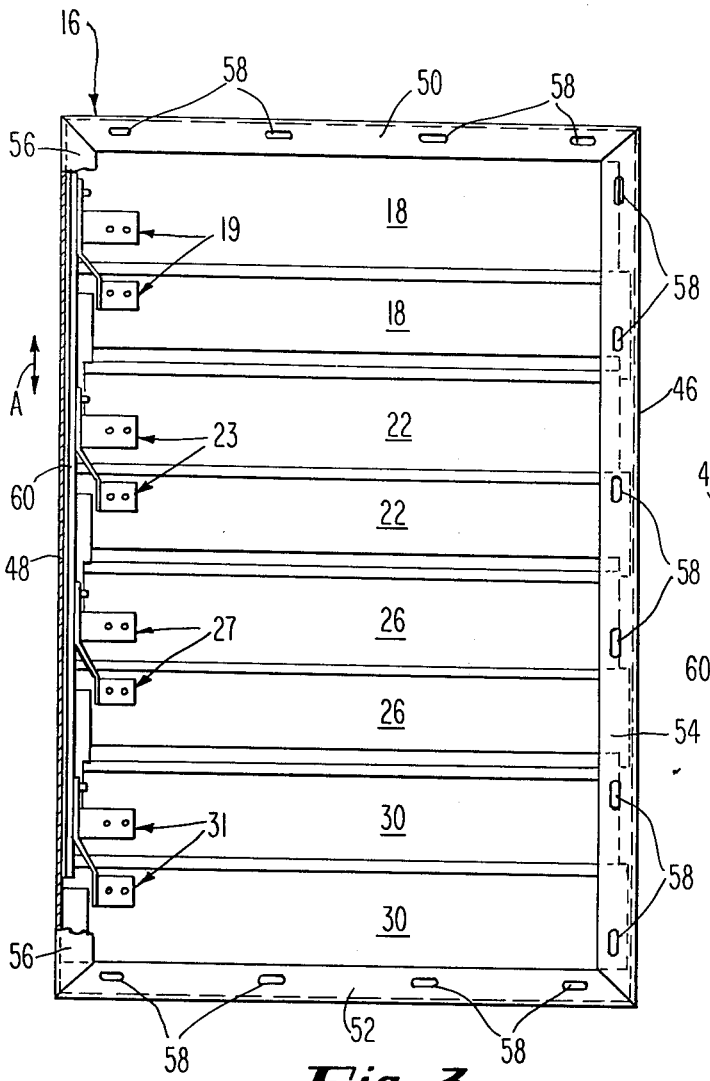
FIG. 3 is a back view of the preferred embodiment of the present invention as shown in FIG. 1, taken as indicated by the lines and arrows 3—3 in FIG. 1.

Referring now to FIG. 3 which is a back view of the preferred embodiment of the present invention, additional inwardly depending top and bottom back flanges 50 and 52 are illustrated together with inwardly depending back-side flanges 54 and 56. For clarity, a maor portion of back-side flange 56 has been cut away in order to clearly illustrate the means for articulating each of the blades with respect to each other and with respect to the frame. These back flanges are generally parallel to the aforementioned inwardly depending flanges 34, 36, 38, and 40 and provide means for mounting the damper on a wall such as illustrated in FIG. 1 by using screw slots 58. The means for simultaneously articulating or rotating each of the blades 18, 22, 26, and 30 with respect to each other and with respect to the frame is clearly illustrated. This means is preferably disposed against an interior surface of side wall 48 of the frame, said means generally comprising blade engaging brackets 19, 23, 27, and 31, which brackets are pinned for rotational movement with respect to rod 60. Rod 60 in turn is appropriately movable along an axis parallel to the axis defined by double-ended arrow A in FIG. 3 to cause each of the blades to assume a preselected orientation with respect to the frame.

Figure 2:
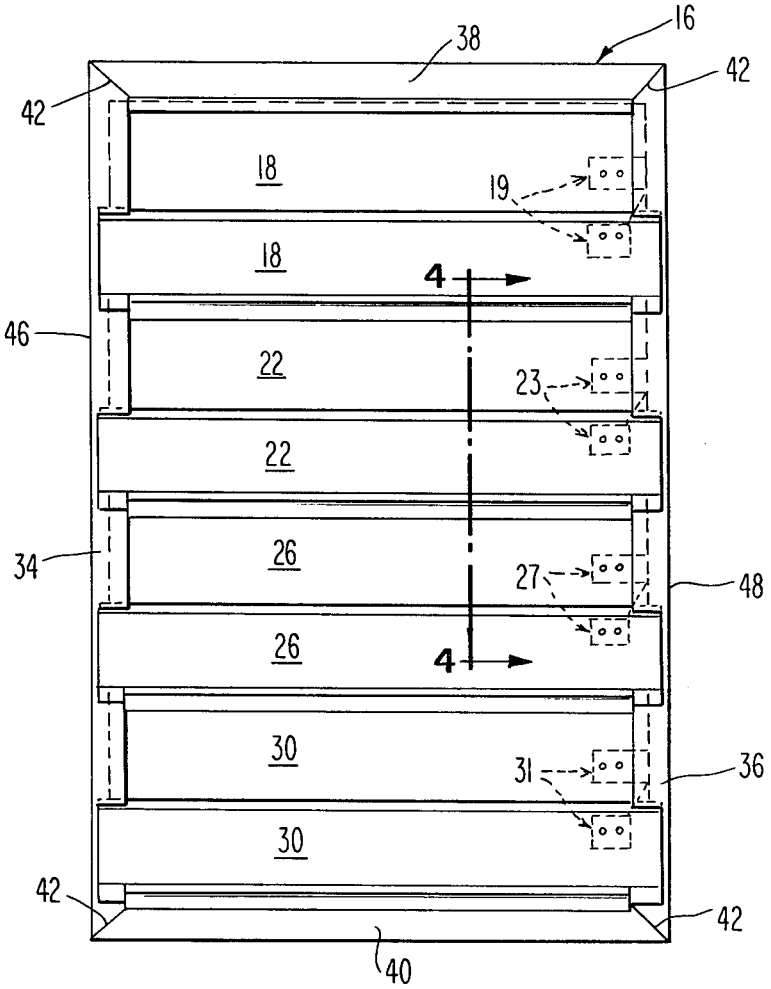
FIG. 2 is a front view of the preferred embodiment of the present invention.
Figure 4:
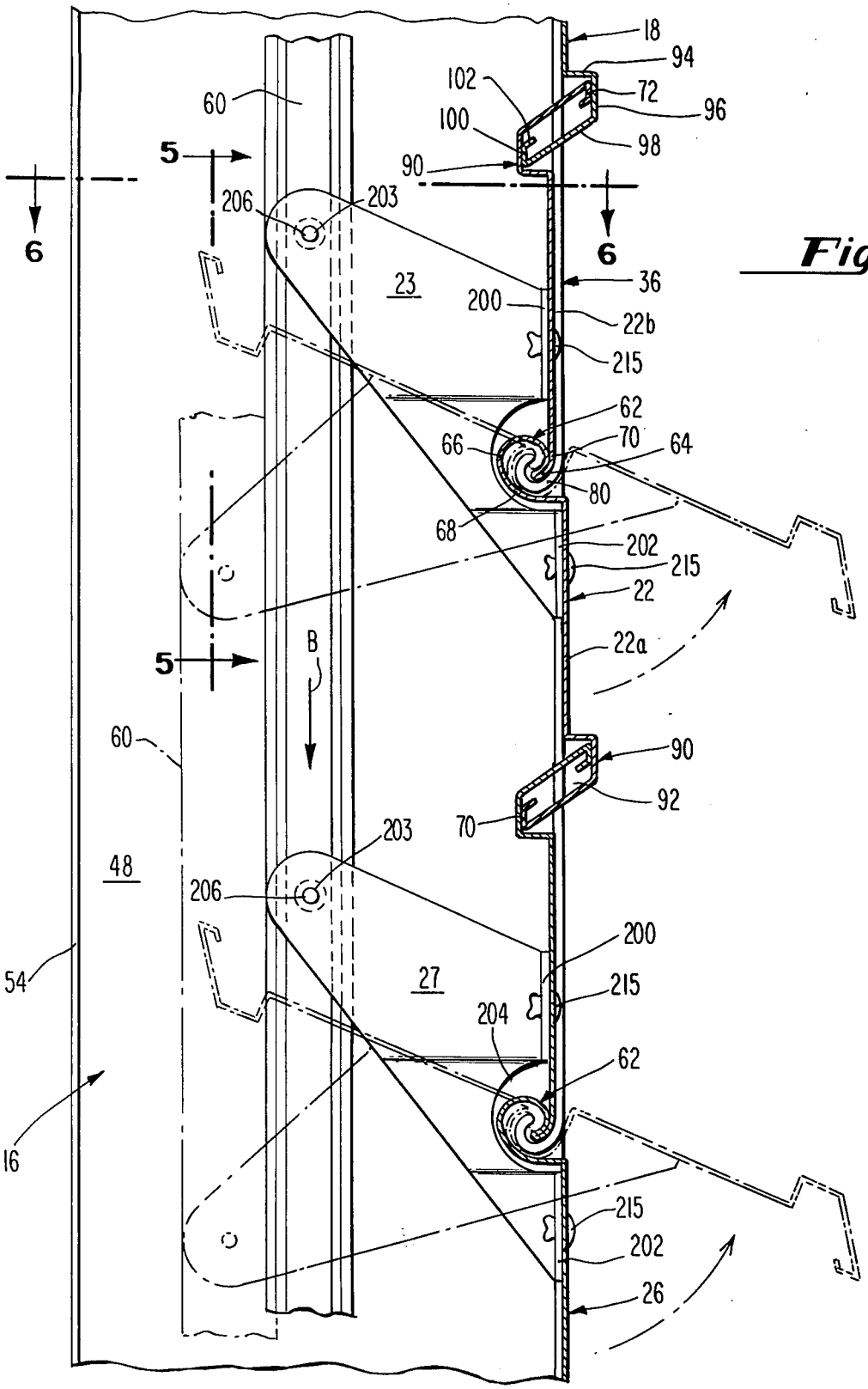
FIG. 4 is a greatly enlarged cross-section of a portion of the preferred embodiment of the present invention illustrated in FIG. 2, taken as indicated by the lines and arrows 4—4 in FIG. 2, and further wherein the open position of the blades with respect to the frame is shown in phantom.

Referring now to FIG. 4, which is a cross-section of a portion of the preferred embodiment shown in FIG. 2, the relative positions of the blades are shown in two different positions. Blade 22 and a portion of blades 18 and 26 are shown disposed in the closed position with respect to inwardly depending flange 36. In a phantom view, blades 22 and 26 are rotated to the open position, which opening is accomplished by movement of rod 60 along the axis as indicated by arrow D in FIG. 4 to the phantom position.

Referring now specifically to the particular blade configuration utilized in the preferred embodiment of the present invention, the blade designated generally 22 has disposed intermediate between the two longitudinal edges thereof a hinge portion designated generally 62. This hinge portion may be roll formed in the blade extending longitudinally across its length. Hinge portion 62 generally comprises hinge tip 64, rounded portion 66, blade offset 68 and overlapping portion 70. My previously issued patent, U.S. Pat. No. 3,908,529, discloses a backdraft damper with a particular blade frame hinging interaction.

As seen in FIG. 4, each blade, such as blade 22, is defined by the hinge portion designated generally 62 into two distinct sections: a first outer blade section 22*a* disposed between the hinge portion designated generally 62 and first blade tip 70; and a second inner blade section 22*b* which is disposed generally between the hinge portion designated generally 62 and second blade-tip 72. As clearly illustrated in FIG. 4, the inner blade section 22*b* and the outer blade section 22*a* are parallel and slightly spaced apart, which spacing is generally established by the configuration of hinge portion 62 and in particular by the length of blade off-set 68. In the preferred embodiment as shown in FIG. 4, the outer blade section 22*a* and inner blade section 22*b* are spaced apart by a distance which is substantially equal to the thickness of the inwardly depending flange designated generally 36 in FIG. 4. Inwardly depending flange 36 is formed into a hook-shaped hinge element designated generally 80, which hinge element is formed by notching the appropriate portions of inwardly depending flanges 34 and 36 on opposite sides so that each of the hinge elements such as hook-shaped hinge element 80 are disposed on opposite sides of the frame for engagement in articulated rotational relationship with hinge portion 62 of each respective blade.

By so constructing each of the blades in rotating blade fire damper so that a hinge portion is, as shown in FIG. 4, generally formed intermediate between the tips of the blade, and then by corresponding off-setting each of two sections of that blade by the width of the associated inwardly depending flanges of that blade, it is possible to form an effective seal along the ends of each of said blades which are contiguous to said inwardly depending flanges. As shown in FIG. 4, inner blade section 22*b* is firmly pressed up against the inner surface of inwardly depending flange 36. Following the blade downwards along flange 36, overlapping portion 70 of the hinge portion designated generally 62 is seen to form a seal between it and the interior surface of the base of the hook-shaped hinge element designated generally 80 formed in the flange. Therefore, the inner blade section and the overlapping portion of the hinge portion 62 form a seal with the inner surface of inwardly depending flange 36, while the blade off-set 68 extends outwardly beyond the outer surface of inwardly depending flange 36 so that the outer blade section 22*a* will, when the blade is is in the closed position, form a seal between the blade and an outer surface of inwardly depending flagne 36.

Another feature of the present invention is the unique sealing arrangement which is effected between adjacent blades along the portions of those blades adjacent to their longitudinal edges. Each longitudinal edge portion of said blade designated generally 90 for blade 22 is formed into a hook-shaped configuration. Each of the hook-shaped configurations formed on these longitudinal edge portions open towards the inwardly depending flange 36. For example, a first upper longitudinal edge portion 90 opens towards the inwardly depending flange 36. Similarly, the other longitudinal edge portion designated generally 90 opens in the opposite direction from the first longitudinal edge portion 90, but nonetheless towards inwardly depending flange 36 due to the disposition of outer blade section 22*a* on the opposite side of inwardly depending flange 36. Each of the longitudinal end portions of a particular blade are formed into a plurality of portions which portions act to form a chamber or chambers 92 which are "dead air" chambers formed between the longitudinal edge portions of adjacent blades when those blades are in the closed position. Therefore, offsetting portion 94, extension portion 96, transverse portion 98 and tip 100 are formed to coact with the analogous portions on an adjacent blade in the closed position to form the aforementioned chamber 92. In particular, the function of offsetting portion 94 is to move the interior surface of extension portion 96 away from the plane of the contiguous section of the blade so that upon the slight misalignment and/or slight opening of the blades, the leading edge of the blade (i.e. the edge formed at the intersection of the transverse portion 98 and the tip 100) will move in an arc substantially parallel to the surface of the offsetting portion 94 so that a seal will be substantially maintained through an arc of the leading edge having a length of approximately one-half of the length of the offsetting portion. In FIG. 4, the spaces illustrated between the leading edges and the offsetting portions are somewhat exaggerated. In alternate embodiments, the offsetting portion may be curved or otherwise shaped to more closely approximate the arc of the leading edge to thereby maximize the wiping action thereof. The length of the offsetting portion may similarly be varied depending upon the desired arc of blade rotation while maintining the double seal between the blades. A serpentine air path will also be formed as the blades open slightly beyond said arc or in the event of leakage between the leading edge and the offsetting portions, which poses maximum resistance to air impinging on either side of the fire damper. As previously mentioned, a double seal is also formed between the tips 100 of adjacent blades and the interior surface of the extension portions 96 of adjacent blades, each of which is parallel to but spaced apart from the plane of their adjacent blade sections when the blades are in the fully closed position. Transverse portions 98 of adjacent blades are substantially parallel to each other when said blades are in the closed position, thereby imparting, together with the aforementioned portions, a cross-sectional configuration to chamber 92 which is a parallelogram having its shorter parallel sides formed by tips 100 and extension portions 96 and longer sides formed by transverse portions 98. Spoilers 102 are additionally disposed on each of the tips 100 which act to increase the turbulence of the air which would tend to pass through the chamber 92 in the aforementioned serpentine fashion as the blades are moved as aforesaid. Thus, a double seal will exist as long as the tip 100 of one blade is disposed coplanar with or on the opposite side of the plane defined by the contiguous section of the adjacent blade.

Referring now to the means for articulating the blades with respect to each other and with respect to the frame, blade engaging brackets 23 and 27 are illustrated in FIG. 4 and are seen to comprise base portions 200 and 202 which are offset to firmly engage the respective blade sections and are riveted thereto. Extending generally away in a triangular manner from base portions 200 and 202 towards a fulcrum point 203 at which a pivot 206 is disposed, these blade engaging brackets are connected pivotally with rod 60 so that upon movement of any one of the aforementioned blades or of the rod 60 along the axis as indicated by arrow B in FIG. 4, each of the blades moves to a position such as the position shown in phantom in FIG. 4 which has been referred to herein as "the open position" of the blades with respect to the frame. In this position, the relative proportions of the hook-shaped portions formed on the longitudinal edge portions 90 of each of the blades is seen to be relatively minor with respect to the width of the blades, thereby permitting air to freely pass through the damper when the damper is in the open position. Disposed between base portions 200 and 202 of each of the blade engaging brackets is an arcuate cut-out 204 which allows clearance for the aforementioned hinge portion designated generally 62 of each of the respective associated blades.

Figure 5:
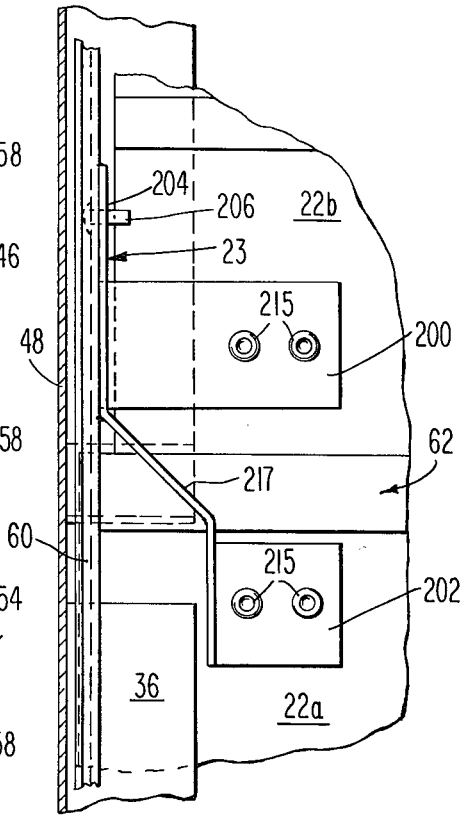
FIG. 5 is an enlarged cut-away back view of the preferred embodiment of the present invention as illustrated in FIG. 4, taken as indicated by the lines and arrows 5—5 in FIG. 4.
Figure 6:
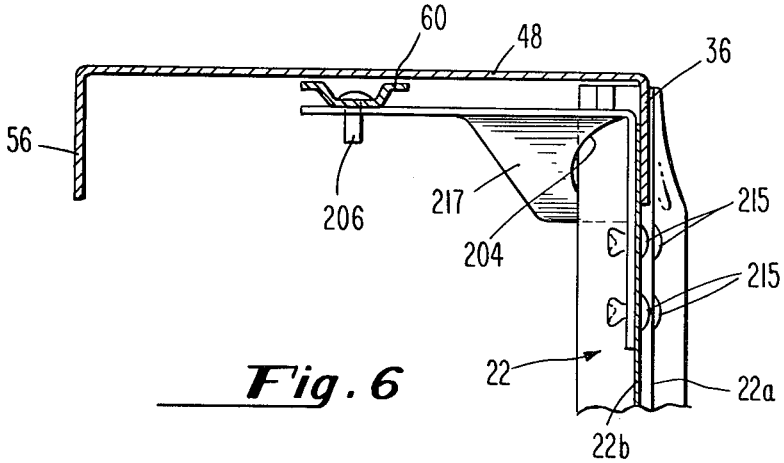
FIG. 6 is an enlarged cross-sectional top view of a portion of the preferred embodiment as illustrated in FIG. 4, taken as indicated by the lines and arrows 6—6 in FIG. 4.

Referring now to FIG. 5 which is an enlarged cutaway back view of one of the blade engaging brackets, namely blade engaging bracket designated generally 23, it will be seen that rod 60 is disposed substantially adjacent to side wall 48. The placement of rod 60 substantially adjacent to side wall 48 provides many advantages to the preferred embodiment of the device. By placing this means substantially adjacent to the wall, the flow of air is uninterrupted by this means which is substantially concealed behind inwardly depending flange 36. By configuring the rods 60 as shown in the top cross-section in FIG. 6 spaced apart portions are provided to slide along the inner surface of the side wall 48 while a parallel spaced apart pivot surface is provided to retain the rivet-shaped pivot shown in FIG. 6. The pivot 206 is seen to have a rounded head and, in one embodiment, may not be fastened in any manner to either rod 60 or its associated bracket since the retention of the rod against the side wall 48 makes it impossible for the pivot 206 to fall out or become otherwise disassociated with the device. Further, the fact that parallel spaced apart sliding portions are disposed on the rod prevents the rod 60 from twisting with respect to the side wall 48, thereby minimizing wear on the pivot itself. By slightly foreshortening the inner blade section 22*b* as seen in FIG. 5 so that in the open position, that blade section will clear the appropriate portion of the rod 60. The entire linkage is now neatly contained in the frame behind the inwardly depending flange as illustrated in FIGS. 4, 5, and 6. This interlocking linkage assembly therefore provides many advantages over prior art devices, including the additional advantage of being easily assembled. Base portion 200 as well as base portion 202 extend substantially parallel to each other and are disposed against the inner surfaces of both the inner blade section **22*b* and the outer blade section 22*a*, these blade sections being riveted by rivets 215 to each of these sections of the blade. Each set of rivets 215 will fixedly engage the base 200 and base 202 to portions of the respective sections of the blade in a line which is substantially parallel to the side wall 48 of the frame, thereby reducing the possibility that any torques could be created on the blade which would tend to unnecessarily distort or tend to distort the aforementioned hinge elements. Another advantage over the prior art with respect to the linkage means of the present invention is that the linkage is neatly contained within the frame, and more particularly, is disposed so that the linkage is substantially contained between the plane of the blades in the closed position and the tips of the inwardly extending blade portions in the open position. It is therefore possible to construct a damper having an overall required depth of clearance which is no greater than that which is required to facilitate the rotation of the blades, while at the same time, providing a linkage means which is substantially disposed between the side wall of the frame and a plane parallel to to the innermost edge of the appropriate inwardly depending flange. With the exception of the portions of the blade engaging brackets, namely the bases 200 and 202**, which lie flat against and therefore do not interfere with the air flow through the damper, substantially all of the linkage means is disposed behind the inwardly depending flange and therefore, out of the flow of air through the device.

In order to clear inwardly depending flange 36, as seen in FIG. 5, a diagonal portion 217 is formed in each blade engaging bracket so that the base portion 202 of each blade engaging bracket will not interfere with any portion of inwardly depending flange 36. This diagonal portion 217 is also clearly illustrated in FIG. 6 which is a top cross-sectional cut-away view of a portion of a means for articulating the blades with respect to each other and with respect to the frame.

Figure 7:
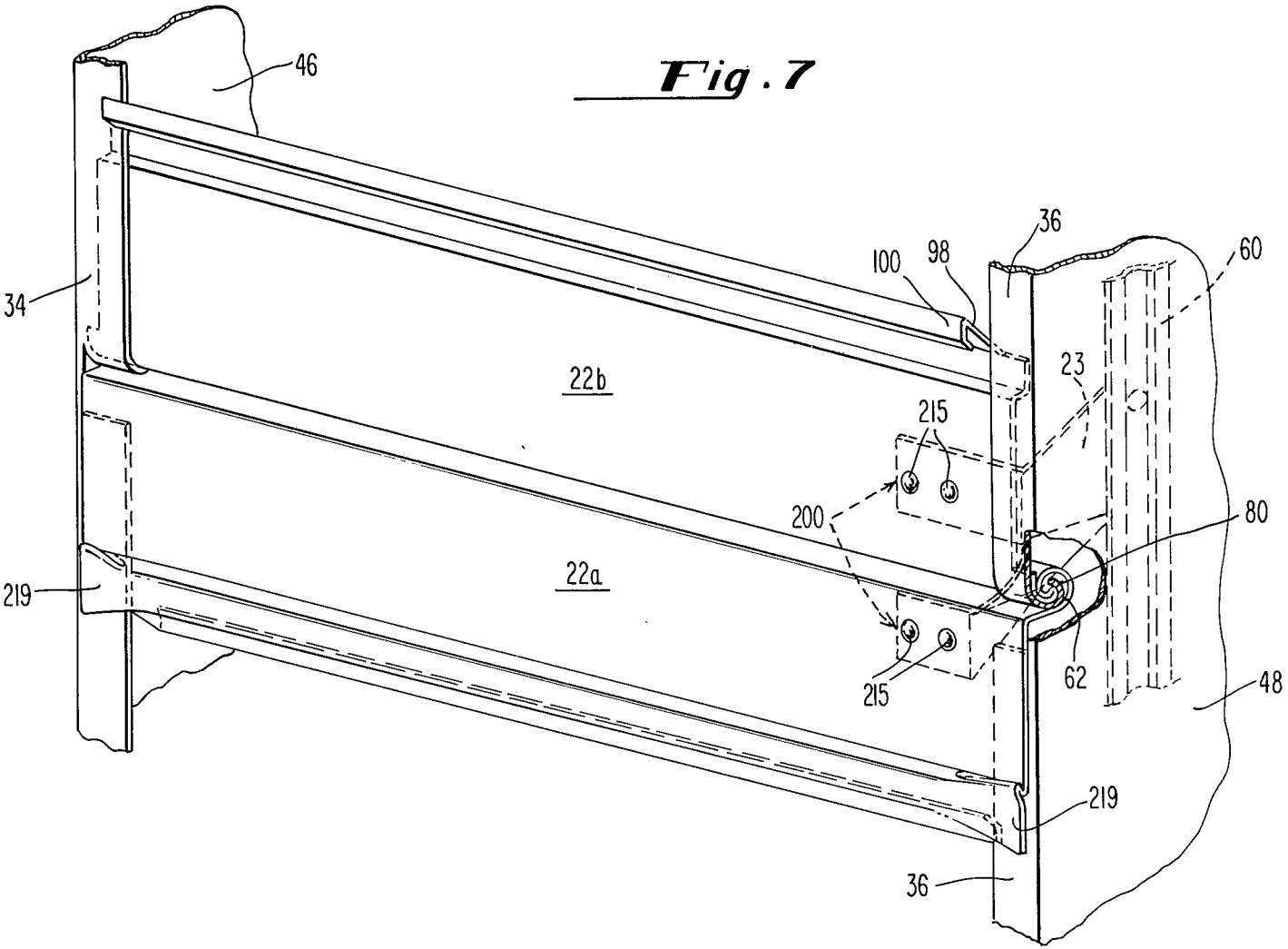
FIG. 7 is a greatly enlarged perspective view of a portion of the preferred embodiment of the present invention wherein a portion of the frame has been cut away to show the hinge detail.

In order to close off the air chamber to form a seal between the outer section **22*a* of each blade and the respective associated portion of inwardly depending flange 36, a crimping process is utilized to crimp terminal portion 219 of outer section 22*a* of the blade so that a continuous seal is formed therebetween. Additionally, a notch may be formed, somewhat reducing the longitudinal dimension of a portion of the transverse portion 98, tip portion 100, and spoiler 102 as illustrated in FIG. 7 in order to allow those portions to extend beyond the plane of inwardly depending flange 36 or, as illustrated in FIG. 7, upwards from the plane of the paper to effectuate the interengagement illustrated in FIG. 4. Alternatively, notching may be replaced with a similar crimping process as illustrated for portion 219 in FIG. 7 whereby a double seal will be formed between the overlapping blade outer section 22*a* and the inner section of the adjacent blade which section corresponds to 22*b* as illustrated in FIG. 7. The notching of inwardly depending flange 36 to form hook-shaped hinge element 80 is also clearly illustrated in FIG. 7**.

From the above description, it can be seen that an extremely effective seal is created between each of the blades, the adjacent blades contiguous thereto, and the respective surfaces of the inwardly depending flanges of the frame. As a result, an extremely effective rotating blade fire damper is accomplished which utilizes certain novel features as disclosed herein to form an extremely rigid, effective fire resistant fire damper.

It will be understood that various changes in the details, materials and arrangement of parts which have been described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. In a fire and air control damper having a frame, a plurality of blades and rotation means for allowing selective rotational displacement of said blades with respect to said frame between open and closed positions, the improvement wherein said frame comprises an inwardly depending flange disposed within a plane which is parallel to the plane of said blades in the closed position and wherein first and second substantially parallel blade sections sealingly engage first and second opposing sides of said inwardly depending flange when said blades are in the closed position, the longitudinal edges of adjacent blades being configured to form opposing hook-shaped portions, said hook-shaped portions each comprising a transverse portion extending generally away from the plane of said blade and a tip portion spaced apart from said transverse portion to form the leading edge of said blade upon the rotation of said blade, said tip portion of each hook-shaped portion being configured to engage an interior surface of the hook-shaped portion of each adjacent blade in the closed position and to cooperate with a surface of the transverse portion to slidingly engage said surface through a predetermined arc of blade rotation as the blades are moved from the closed towards the open position, whereby a double seal is maintained in the closed position and through said predetermined arc of blade rotation.

2. The invention of claim 1 wherein said tip portion further comprises a substantially planar surface which is parallel and offset from the plane of said blade, and wherein said hook-shaped end portion further comprises an extension portion extending between said tip portion and said transverse portion, said extension portion comprising a substantially planar surface which sealingly mates with said tip portion surface when said blades are in the closed position.

3. The invention of claim 2 wherein said hook-shaped portion further comprises a spoiler inwardly depending from said tip portion for increasing the fluid frictional resistance of the air path initially formed as said blades move from the closed towards the open position.

* * * * *